US008023837B2

(12) United States Patent
Nishitani et al.

(10) Patent No.: US 8,023,837 B2
(45) Date of Patent: Sep. 20, 2011

(54) IMAGE FORMING APPARATUS CAPABLE OF PREVENTING A SHEET JAMMING DURING DETECTED ABNORMAL SITUATIONS

(75) Inventors: Shuji Nishitani, Suntoh-gun (JP); Takateru Okubo, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 615 days.

(21) Appl. No.: 11/872,287

(22) Filed: Oct. 15, 2007

(65) Prior Publication Data

US 2008/0095545 A1 Apr. 24, 2008

(30) Foreign Application Priority Data

Oct. 18, 2006 (JP) ..... 2006-283474

(51) Int. Cl.
*G03G 15/00* (2006.01)

(52) U.S. Cl. ..... 399/18; 399/21; 399/405; 399/406; 271/215; 271/152

(58) Field of Classification Search ..... 399/18, 399/400, 405; 271/215, 152, 176
See application file for complete search history.

(56) References Cited

U.S. PATENT DOCUMENTS 5,270,778 A * 12/1993 Wyer ..... 399/406
5,963,754 A * 10/1999 Itoh et al. ..... 399/21
6,109,606 A * 8/2000 Johnson et al. ..... 271/213
6,666,445 B2 * 12/2003 Yamakawa et al. ..... 271/3.15

FOREIGN PATENT DOCUMENTS

JP 9-249334 9/1997

* cited by examiner

*Primary Examiner* — Matthew G Marini
(74) *Attorney, Agent, or Firm* — Fitzpatrick, Cella, Harper & Scinto

(57) ABSTRACT

The invention provides an image forming apparatus an image forming portion for forming an image on a sheet, a stack portion for stacking a sheet, a discharge portion for discharging the sheet, on which an image is formed by the image forming portion, to the stack portion, a sheet detection portion for detecting a conveying condition of the sheet on which an image is formed, a fully stacked condition detection portion for detecting whether the sheets stacked in the stack portion are in a fully stacked condition, and a determining portion for determining an abnormal condition of the sheet in the stack portion, based, after the detection of a sheet passing by the sheet detection portion, on a result of detection by the fully stacked condition detection portion as to whether the sheets stacked in the stack portion are in a fully stacked condition.

7 Claims, 8 Drawing Sheets

IMAGE FORMING APPARATUS CAPABLE OF PREVENTING A SHEET JAMMING DURING DETECTED ABNORMAL SITUATIONS

BACKGROUND OF THE INVENTION

1. Field of the Invention

The present invention relates to an image forming apparatus such as a copying machine, a printer or a facsimile apparatus, and more particularly to an image forming apparatus utilizing an electrophotographic process.

2. Description of the Related Art

A schematic constitution of a general image forming apparatus utilizing the electrophotographic process will be described with reference to FIG. 7.

An image forming apparatus 700 is equipped with a sheet cassette 50. Sheets P contained in the sheet cassette 50 are advanced by a pickup roller 8*a*. On thus advanced sheet P, a desired image is formed in an image forming portion 101. The image forming portion 101 includes detachable process cartridges 7*a* to 7*d*. The process cartridges 7*a* to 7*d* include photosensitive drums 1*a* to 1*d*, charging rollers 2*a* to 2*d* for charging the photosensitive drums 1*a* to 1*d*, developing devices 4*a* to 4*d* for forming toner images on the photosensitive drums 1*a* to 1*d*.

A transfer-conveyor belt 9 conveys the sheet P, advanced by the pickup roller 8*a*, to the image forming portion 101. Transfer rollers 5*a* to 5*d* are disposed at positions opposed to the photosensitive drums 1*a* to 1*d*. The transfer rollers 5*a* to 5*d* press the sheet P toward the photosensitive drums 1*a* to 1*d* across the transfer-conveyor belt 9 and are given a voltage of a polarity opposite to that of the toner image, whereby the toner images are transferred onto the sheet P.

At a downstream side of the image forming portion 101 in the sheet conveying direction, there is provided a fixing unit 40 for fixing the toner images, transferred onto the sheet P, to the sheet P. The sheet P having received the transfer of toner images in the image forming portion 101 is conveyed to the fixing unit 40, in which the toner images are fixed. The sheet P, on which the toner images are fixed in the fixing unit 40, is discharged onto a stacking tray 301, by a discharge roller 302 and a discharge idler 303 opposed to the discharge roller 302.

The discharged sheets P are piled up on the stacking tray 301. Usually the user recovers the discharged sheets P at each discharge or at a suitable timing. However, in the case that the sheets are not recovered, for example because the user forgets to execute the recovery, there has resulted a situation where the sheets P are stacked in excess of the capacity of the stacking tray 301. Thus, such over-stacking of the sheets P has lead to a sticking-out of the sheet P from the stacking tray 301, a dropping of the sheet P from the image forming apparatus 700, or a sheet jamming.

Therefore, in order to avoid an over-stacking of the discharged sheets on the stacking tray, there are proposed a conveying apparatus and an image forming apparatus, equipped with a sheet stack amount detection unit for detecting the stacking of sheets of a prescribed amount (for example cf. Japanese Patent Application Laid-Open No. H09-249334).

However, when the sheet P is let to stand on the stacking tray 301, sheet P may be curled (rounded up) by moisture absorption on the stacking tray 301. Under an environment of a high temperature or a high humidity, the sheet P left on the stacking tray tends to be curled more easily. Also in the case that the distance from the fixing unit 40 to the discharge portion is short, the sheet P is discharged without being cooled sufficiently, so that, particularly in a sheet of a low stiffness such as an OHT (Over Head Transparency) sheet, the sheet P may be curled up on the stacking tray 301. Also in the case that the sheet P is not sufficiently cooled before being discharged, the toner image may be discharged before being completely fixed to the sheet P. In such case, the unfixed toner image on the sheet P is stacked on and adheres to a sheet P already discharged onto the stacking tray 301, whereby the trailing end of the sheet P is not completely discharged from the discharge port but the sheet P remains in the discharge portion.

In case of such abnormal state where the sheet P is curled on the stacking tray 301 or remains in an incomplete discharge state, the detection by the sheet stacking amount detection unit is not executed property, thus leading to a sheet jamming.

SUMMARY OF THE INVENTION

An object of the present invention is to provide an image forming apparatus capable of preventing a sheet jamming in case of abnormal situations as described above.

A purpose of the invention is to provide an image forming apparatus having a stack portion for stacking a sheet on which an image has been formed to solve the aforementioned problem.

Another purpose of the invention is to provide an image forming apparatus including an image forming portion for forming an image on a sheet, a discharge portion for discharging a sheet on which an image has been formed to the stack portion, a sheet detection portion for detecting a conveying state of the sheet on which an image has been formed, a fully stacked condition detection portion for detecting whether the sheets stacked in the stack portion are in a fully stacked condition, and a determining portion for determining an abnormal condition of the sheet in the stack portion, based on a result of detection by the fully stacked condition detection portion after the sheet detection portion detects a sheet passing through.

A further purpose of the present invention will become apparent from the following description of exemplary embodiments, with reference to the attached drawings.

DESCRIPTION OF THE EMBODIMENTS

Now the preferred form for executing the present invention will be described with a following exemplary embodiment.

However, dimension, material and shape of a constituent component and a relative positioning thereof, described in the present exemplary embodiment, are not to be construed to restrict the scope of the invention thereto unless specified otherwise.

Exemplary Embodiment

In the following, an image forming apparatus of the present exemplary embodiment will be described with reference to the accompanying drawings.

Figure 3:
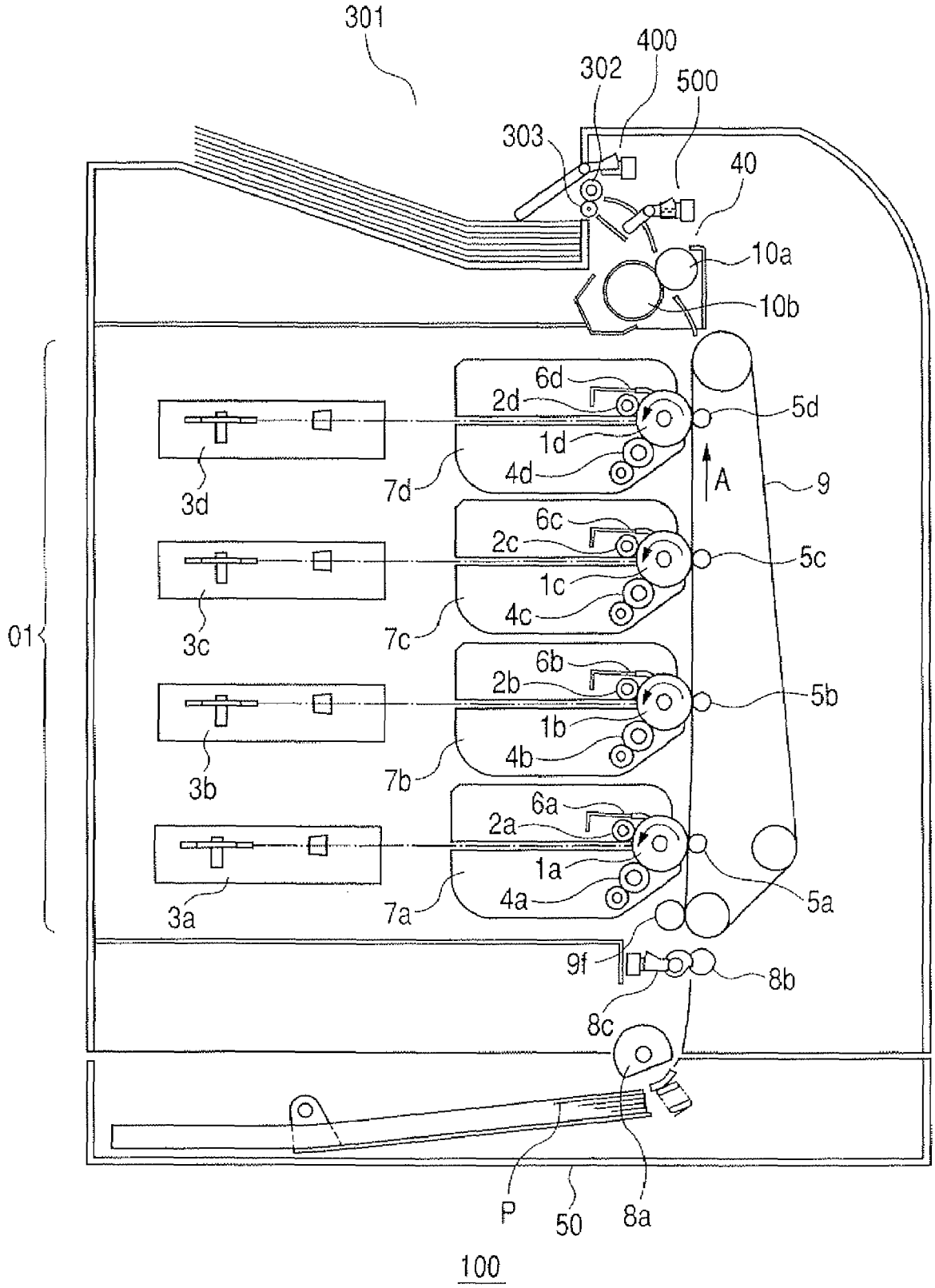
FIG. 3 is a schematic cross-sectional view of an image forming apparatus.
Figure 7:
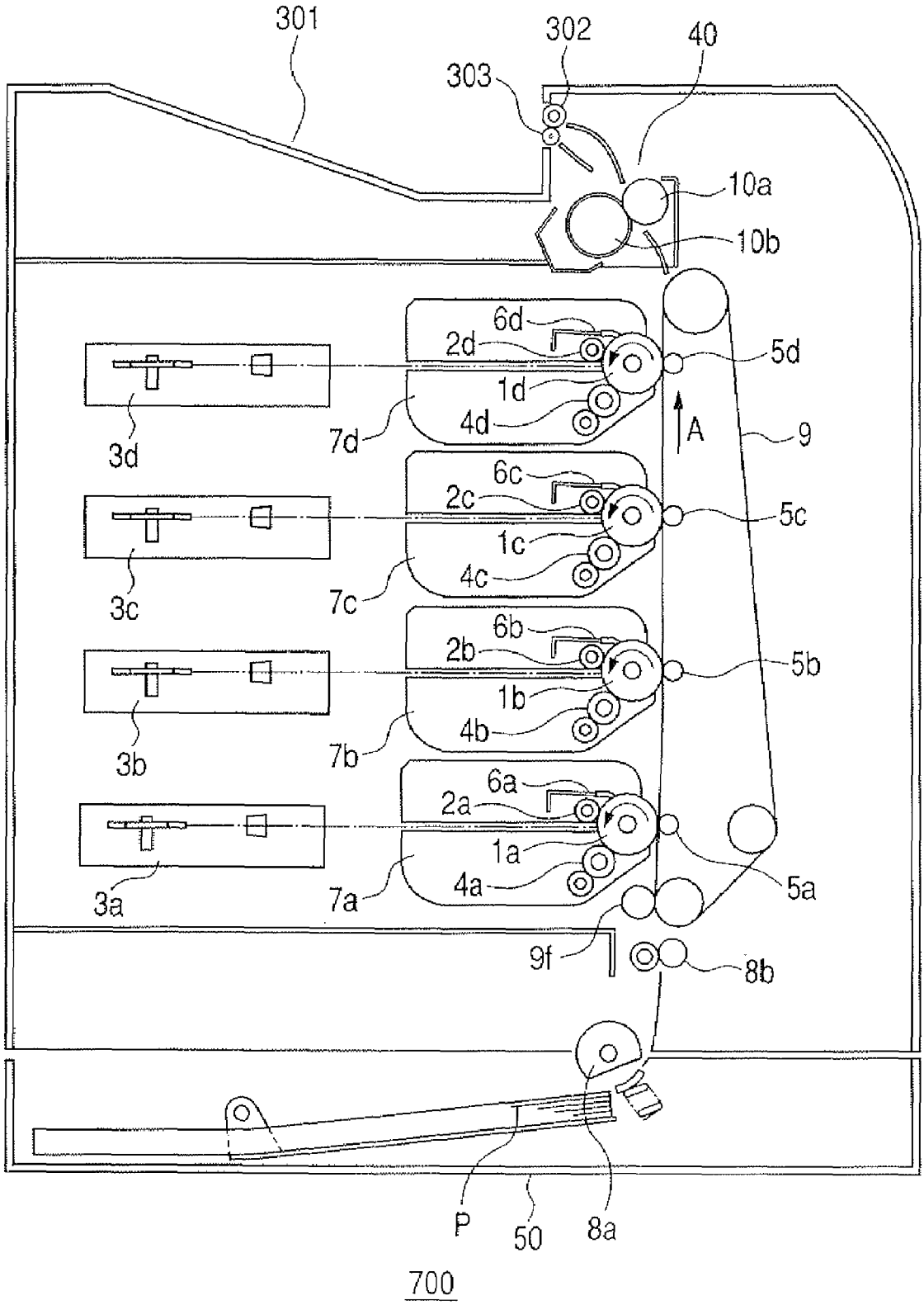
FIG. 7 is a schematic cross-sectional view of an ordinary image forming apparatus utilizing an electrophotographic process.

FIG. 3 is a schematic cross-sectional view of an image forming apparatus of the present exemplary embodiment. As the image forming apparatus of the present exemplary embodiment, a full-color image forming apparatus having four photosensitive drums is utilized, among various image forming apparatuses utilizing the electrophotographic process. In FIG. 3, same constitutions as those in the prior image forming apparatus illustrated in FIG. 7 are represented by same symbols.

The image forming portion 101 of the image forming apparatus 100 includes detachable process cartridges 7*a*, 7*b*, 7*c* and 7*d* (hereinafter represented as 7*a*-7*d*) containing, as developers, toners of different colors for example four toners of cyan, yellow, magenta and black colors. The process cartridges 7*a*-7*d* respectively have following constitutions. There are provided, at first, photosensitive drums 1*a*, 1*b*, 1*c* and 1*d* (hereinafter represented as 1*a*-1*d*) serving as image bearing members rotated counterclockwise in the illustration in FIG. 1. Also provided are charging rollers 2*a*, 2*b*, 2*c* and 2*d* (hereinafter represented as 2*a*-2*d*) serving as charging means for charging the surfaces of the photosensitive drums 1*a*-1*d*. Further provided are developing devices 4*a*, 4*b*, 4*c* and 4*d* (hereinafter represented as 4*a*-4*d*) serving as developing means for developing electrostatic latent images, which are formed on the photosensitive drums 1*a*-1*d* by laser lights emitting from scanner units 3*a*, 3*b*, 3*c* and 3*d* (hereinafter represented as 3*a*-3*d*) to be described later, into visible toner images. Further provided are cleaning blades 6*a*, 6*b*, 6*c* and 6*d* (hereinafter represented as 6*a*-6*d*) serving as cleaning means for toners remaining on the photosensitive drums after the transfer of toner images onto a sheet P.

The image forming portion 101 is equipped with the scanner units 3*a*-3*d* serving as exposure means for irradiating laser lights based input image information to form electrostatic latent images on the surfaces of the photosensitive drums 1*a*-1*d*. It is further equipped with transfer rollers 5*a*, 5*b*, 5*c* and 5*d* (hereinafter represented as 5*a*-5*d*) serving as transfer means for transferring the toner images, formed on the surfaces of the photosensitive drums 1*a*-1*d*, onto a sheet P conveyed by the transfer-conveyor belt 9. The transfer rollers 5*a*-5*d* are disposed at positioned opposed to the photosensitive drums 1*a* to 1*d*, also press the sheet P to the photosensitive 1*a* to 1*d* across the transfer-conveyor belt 9 and are given a voltage of a polarity opposite to that of the toner images, thereby transferring the toner images onto the sheet P. The process cartridges 7*a*-7*d*, the scanner units 3*a*-3*d* and the transfer rollers 5*a*-5*d* constitute the image forming means in the present invention.

In the image forming portion 101, the surfaces of the photosensitive drums 1*a* to 1*d* are uniformly changed by the charging rollers 2*a* to 2*d*. Then the scanner units 3*a* to 3*d* emit laser lights to form, on the surfaces of the photosensitive drums 1*a* to 1*d*, electrostatic latent images based on the image information. Then, toners are supplied by the developing devices 4*a*-4*d* to form the electrostatic latent images into visible toner images. The toner images are transferred, in a transfer portion where the photosensitive drums 1*a*-1*d* and the transfer rollers 5*a*-5*d* are disposed in relative manner, onto the sheet P conveyed by the transfer-conveyor belt 9. The toners remaining on the surfaces of the photosensitive drums 1*a*-1*d* after the transfer are eliminated by the cleaning blades 6*a*-6*d*.

In the sheet feeding portion, the sheet P as a recording medium is separated one by one and advanced by the pickup roller 8*a* from a sheet cassette 50. The advanced sheet P is conveyed, by paired rollers 8*b* and the transfer-conveyor belt 9, to the image forming portion 101. In this operation, a detection portion 8*c* detects the passing of the sheet P, whereby the sheet P is conveyed at a prescribed timing to the image forming portion 101 and the toner images formed on the photosensitive drums 1*a*-1*d* are transferred onto the sheet P. The pickup rollers 8*a*, the paired rollers 8*b*, the transfer-conveyor belt 9 etc. constitute conveying means in the present invention for conveying the sheet P, and are driven by an unillustrated conveying motor.

Similar processes are conducted in succession from the process cartridge 7*a* at the most upstream side in the conveying direction of the sheet to the process cartridge 7*d* at the most downstream side, to transfer four-colored toner images onto the sheet P, thereby forming a full-color image. At the downstream side of the image forming portion 101 in the sheet conveying direction, a fixing unit 40 is disposed as fixing means for fixing the toner images, transferred onto the sheet P, to the sheet P. The fixing unit 40 includes a heating roller 10*a* equipped with an unillustrated heating member, and a pressure roller 10*b* maintained in contact with the heating roller 10*a*, and heats and pressurizes the passing sheet P to fix the toner images to the sheet P. The passing of the sheet P, on which the toner images have been fixed, is detected by a sheet detection portion 500 as discharge means disposed at the downstream side of the fixing portion 40 in the sheet conveying direction.

Thus the sheet P is conveyed to a discharge portion, at the downstream side of the fixing unit 40 in the sheet conveying direction. The sheet P, conveyed to the discharge portion, is discharged, by paired discharge rollers serving as discharge means and constituted of a discharge roller 302 and a discharge idler roller 303 provided in the discharge portion, to the exterior of the apparatus. The discharge sheet P is stacked on the stacking tray 301 serving as a stack portion. The discharge portion is also equipped with a condition detecting portion 400 as means for detecting the condition of the sheet, and the passing of the sheet P is detected by the detecting portion 400.

In the following there will be described a conveying control for the sheet, in the image forming apparatus of the present exemplary embodiment.

FIGS. 1A to 2B are schematic views illustrating the conveying states of the sheet P in the fixing portion and the discharge portion of the image forming apparatus of the present exemplary embodiment.

Figure 1A:
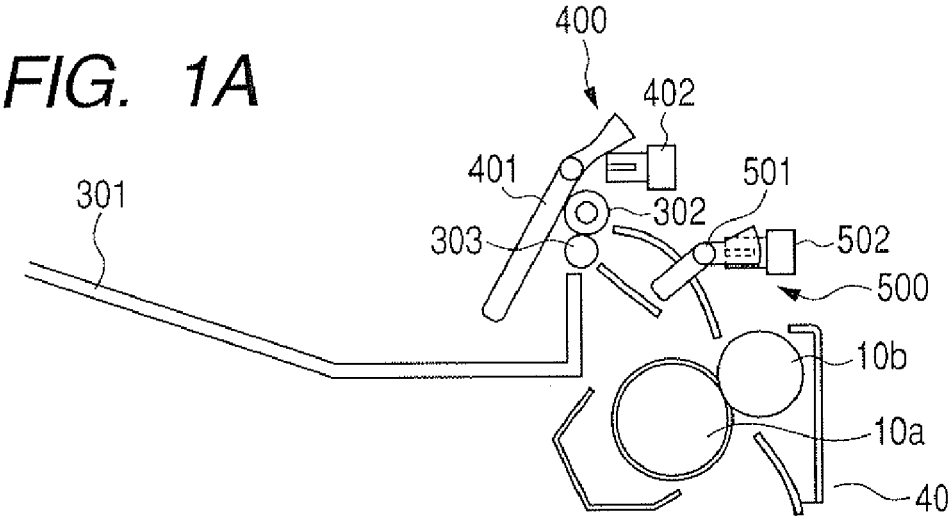
FIGS. 1A, 1B and 1C are schematic views illustrating sheet conveying states in a fixing portion and a discharge portion of an image forming apparatus in an exemplary embodiment 1.
Figure 1B:
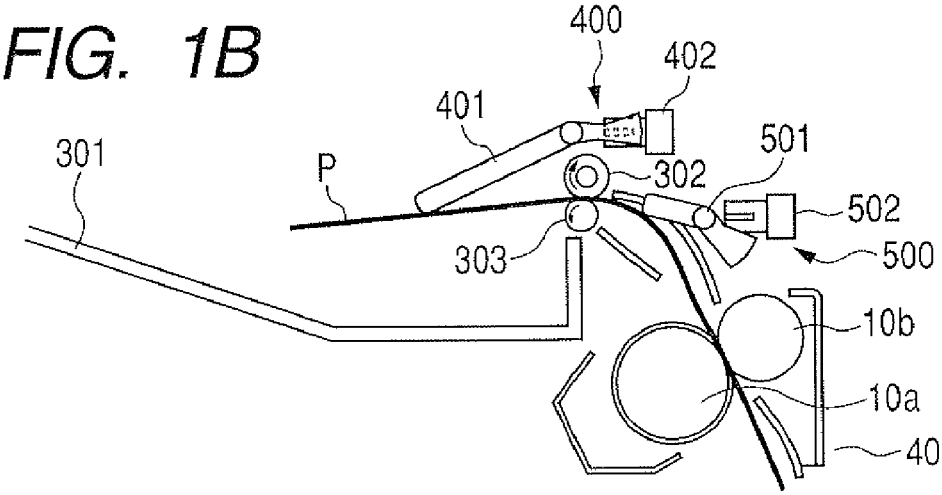
Figure 1C:
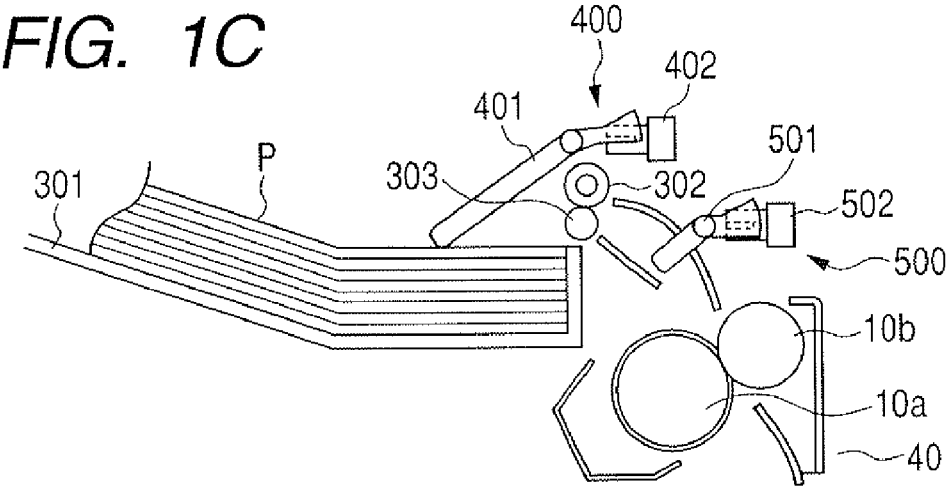
Figure 2A:
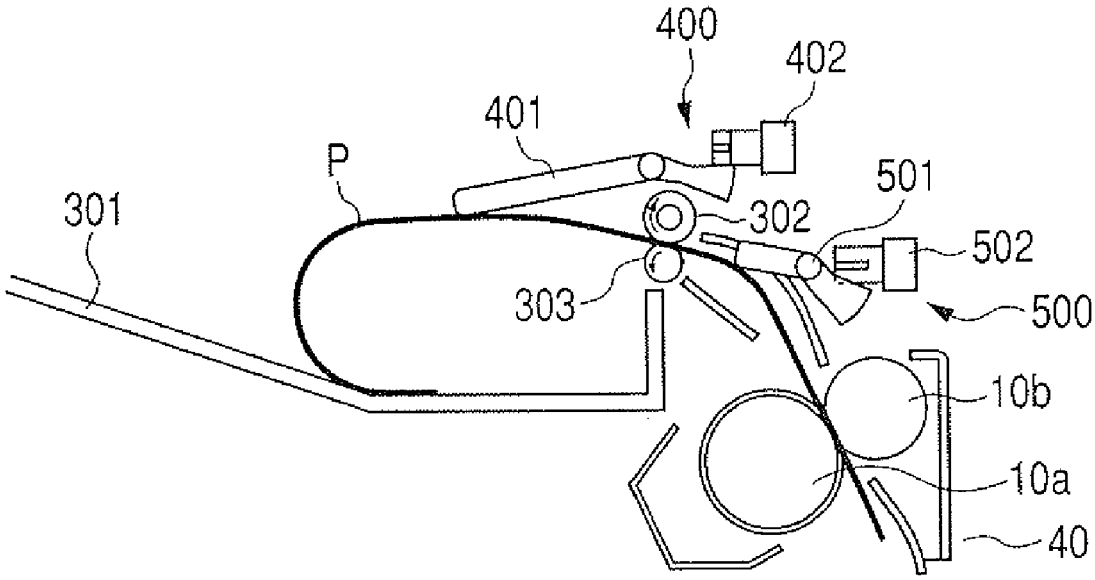
FIGS. 2A and 2B are schematic views illustrating sheet conveying states in a fixing portion and a discharge portion of an image forming apparatus.
Figure 2B:
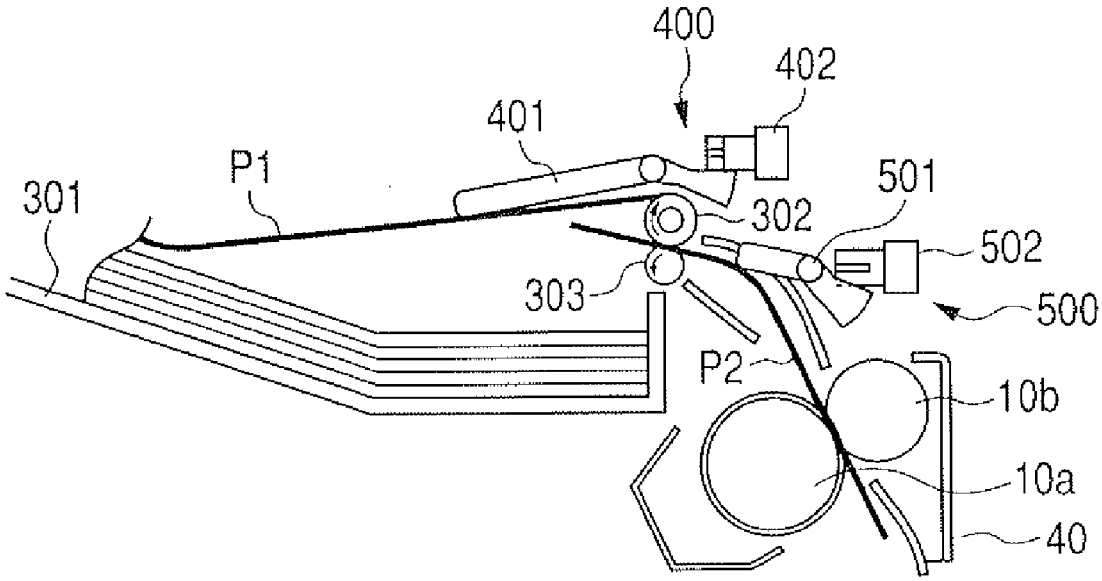

FIG. 1A illustrates a condition where the sheet P is not discharged; FIG. 1B illustrates a condition where the sheet P is discharged; and FIG. 1C illustrates a condition where the sheets P are fully stacked on the stacking tray 301. Also FIGS. 2A and 2B illustrate abnormal conditions. FIG. 2A illustrates a condition where the sheet P is curled on the stacking tray 301, and FIG. 2B illustrates a condition where the sheet P is not discharged completely from the discharge port on the stacking tray 301 but partly remains in the discharge portion.

The condition detection portion 400 is constituted of a lever 401 as a detection member, and a photo-interrupter 402 as a detection sensor. The condition detection portion 400 is a fully stacked condition detecting portion which detects the position of the lever 401 by the detection state of the photo-interruptor 402 thereby detecting the passing of the sheet P and the fully stacked condition of the sheets on the stacking tray 301. The photo-interruptor 402 sends a signal to a CPU to be described later, when the optical path is interrupted by the lever 401. A sheet detection portion 500 is similarly constituted of a lever 501 and a photo-interruptor 502. The sheet detection portion 500 detects the passing of the sheet P, but the photo-interruptor 502 sends a signal to the CPU when the optical path is not interrupted by the lever 501. A detection portion 8*c* has a constitution similar to that of the sheet detection portion 500, and is constituted of a lever and a photo-interruptor.

FIG. 1A illustrates a condition where the sheet P is not stacked on the stacking tray 301, and where the discharge of the sheet P is not conducted. The lever 401 does not intercept the optical path of the photo-interruptor 402, while the lever 501 intercepts the optical path of the photo-interruptor 502. The position of the lever 401 in this condition will be referred to as a first detection position. In particular, the position of the lever 401 in a condition not moved at all as illustrated in FIG. 1A will be referred to as an initial position. When the sheets P are stacked in a small amount, the lever 401 is in the first detection position.

FIG. 1B illustrates a condition where the sheet P is discharged. The lever 401 interrupts the optical path of the photo-interruptor 402, while the lever 501 does not interrupt the optical path of the photo-interruptor 502. The position of the lever 401 in this condition will be referred to as a second detection position. When the trailing end of the sheet P passes through the fixing unit 40, the lever 501 returns to the condition illustrated in FIG. 1A. Also when the trailing end of the sheet P passes through the discharge portion and the discharge operation is completed, the lever 401 returns to the condition illustrated in FIG. 1A (first detection position).

FIG. 1C illustrates a fully stacked condition of the sheets P on the stacking tray 301. During the discharge of the sheet P, the lever 401 interrupts, as illustrated in FIG. 1B, the optical path of the photo-interruptor 402 (second detection position). Even after the completion of discharge of the sheet P, as the sheets P are fully stacked on the stacking tray 301, the lever 401 cannot return to the condition illustrated in FIG. 1A but remains interrupting the optical path of the photo-interruptor 402. Thus, a condition where the sheets P are fully stacked on the stacking tray 301 is recognized.

FIG. 2A illustrates a condition where the sheet P is curled on the stacking tray 301. The lever 401 is rotated larger than in its position in the fully stacked condition of the sheets P illustrated in FIG. 1C. The position of the lever 401 in this condition will be referred to as a third detection position. In this condition, the lever 401 does not interrupt the optical path of the photo-interruptor 402, constituting a first abnormal condition in the discharge portion.

FIG. 2B illustrates a condition where the sheet P on the stacking tray 301 is not completely discharged from the paired discharge rollers and the trailing end of the sheet P1 remains in the discharge portion. The lever 401 is rotated larger than in its position in the fully stacked condition of the sheets P illustrated in FIG. 1C (third detection position). In this condition, the lever 401 does not interrupt the optical path of the photo-interruptor 402, constituting a second abnormal condition in the discharge portion. A sheet P2 is a sheet conveyed in succession to the sheet P1. This second abnormal condition indicates a phenomenon where the trailing end of the discharged sheet, when passing through the paired discharge rollers, remains on the discharge roller 302 at the upstream side. Such phenomenon may occur when the sheet is charged and floats upwards or when the trailing end of the sheet does not pass properly.

The lever 401 is made rotatable widely to the aforementioned the third detection position because of the following reason. For example, when the rotating range of the lever 401 is restricted to the second detection position, and in the case that the discharged sheet P impinges strongly on the lever, the restricted lever will strongly hit the sheet thereby eventually causing a conveying failure of the sheet or a damage on the sheet. For this reason, the lever 401 is made rotatable within a certain range. This situation is also related with the speed of the discharged sheet, and such constitution is adopted as the image forming velocity of the image forming apparatus is being made higher.

Figure 4:
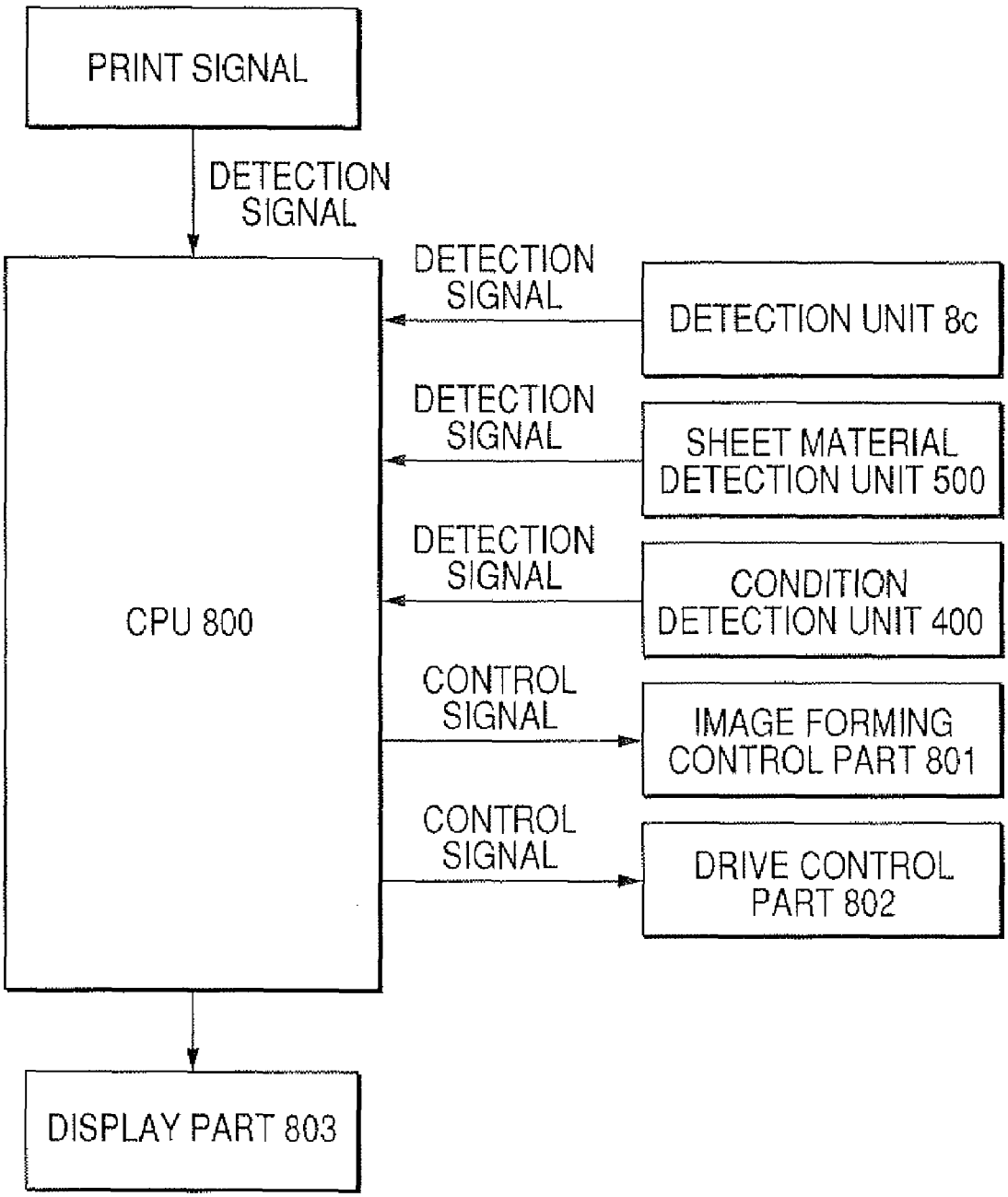
FIG. 4 is a block diagram of a control system for the sheet conveying operation of the image forming apparatus.

FIG. 4 is a block diagram of a control system for sheet conveying.

Referring to FIG. 4, a CPU 800 serves as control means for controlling the entire image forming apparatus 100. The CPU 800 receives, from an unillustrated terminal (host computer), an image forming signal (hereinafter called a print signal). In response to such print signal, it outputs a control signal to an image formation control part 801 thereby instructing an image formation. It also outputs a control signal to a drive control part 802 thereby causing the drive control part 802 to activate the conveying motor, thus driving the pickup roller 8*a*, the paired rollers 8*b* and the transfer-conveyor belt 9. Thus the advancement and conveyance of the sheet P are executed.

The CPU 800 functions as a determining portion for determining the condition of the sheet P, based on the detection signals transmitted from the detection portion 8*c*, the sheet detection portion 500 and the condition detection portion 400 with the convey of the sheet P. It controls the drive control part 802 according to the confirmed condition of the sheet P, thereby controlling the conveying operation for the sheet P. Also based on the signals transmitted from the detection portions, the CPU 800 determines a jammed state of the sheet P, or a fully stacked condition or an abnormal condition of the sheet P on the stacking tray 301. The result thus determined or detected is outputted to a display portion 803 for display thereon.

FIGS. 5A to 5D are timing charts illustrating the detection operations of the sheet detection portion 500 and the condition detection portion 400.

Figure 5A:
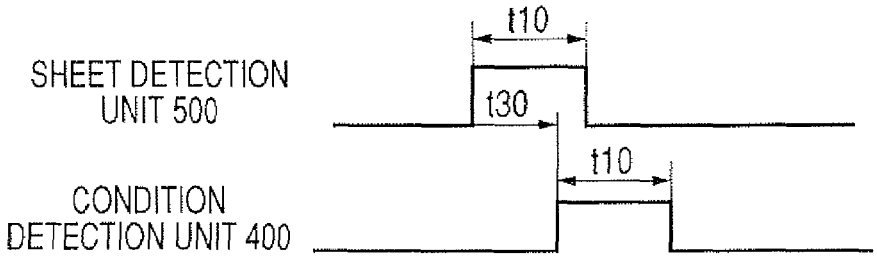
FIGS. 5A, 5B, 5C and 5D are timing charts indicating detecting operations of a sheet detecting portion and a condition detecting portion.

FIG. 5A illustrates a condition corresponding to FIGS. 1A and 1B, where the sheet P is not stacked or stacked in a small amount on the stacking tray 301. The sheet P, after arriving at the sheet detection portion 500, completes passing in a prescribed time t10. Also the sheet P, after arriving at the sheet detection portion 500, reaches the condition detection portion 400 at a prescribed time t30, and after arriving at the condition detection portion 400, completes passing in a prescribed time t10.

Figure 5B:
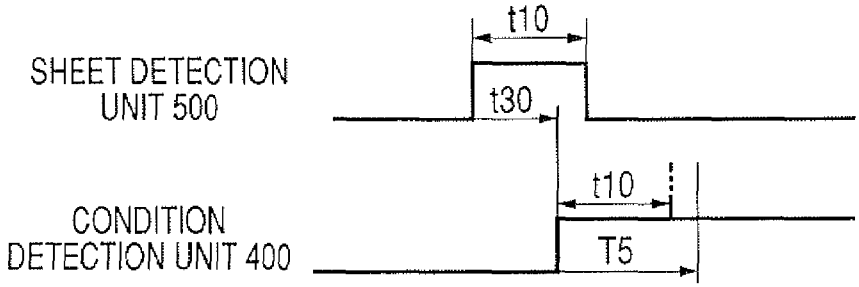

FIG. 5B illustrates a condition corresponding to FIG. 1C, where the sheets P are fully stacked on the stacking tray 301. The sheet P, after arriving at the sheet detection portion 500, reaches the condition detection portion 400 at a prescribed time t30, and completes passing in a prescribed time t10. However, even after the passing of the sheet P through the detection portion 400 of the discharge portion, the optical path of the photo-interruptor 402 of the discharge portion remains interrupted. Therefore, the CPU 800 cannot detect the completion of passing through the detection portion 400 of the discharge portion, even after the lapse of prescribed time t10. Therefore the CPU 800 recognizes a fully stacked condition of the stacking tray 301 when the completion of passing through the detection portion 400 of the discharge portion cannot be detected even after the lapse of a specified time T5 as a third specified time.

Figure 5C:
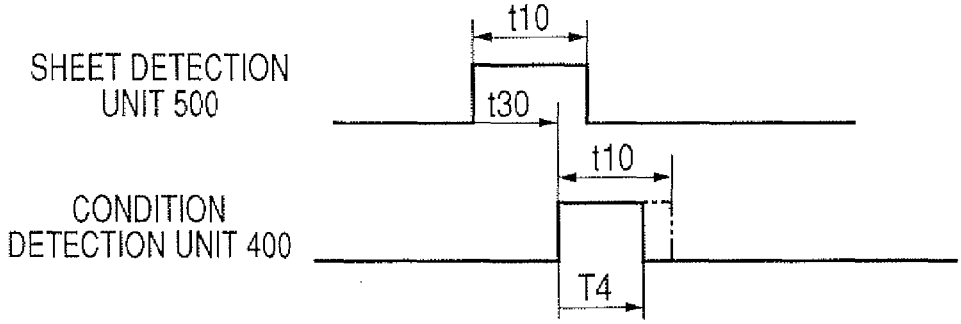

FIG. 5C illustrates a condition corresponding to FIG. 2A, where the sheet P is curled on the stacking tray 301. The sheet P, after arriving at the sheet detection portion 500, reaches the condition detection portion 400 of the discharge portion at a prescribed time t30. However, before the sheet P completely passes through the condition detection portion 400, the lever 401 rotates larger (third detection position) than the position in the fully stacked condition of the sheets P, whereby the optical path of the photo-interruptor 402 is not interrupted. In response, the CPU 800 recognizes a first abnormal condition when the completion of passing through the detection portion 400 of the discharge portion is detected at a specified time T4, as a second specified time, shorter than the prescribed time t10.

Figure 5D:
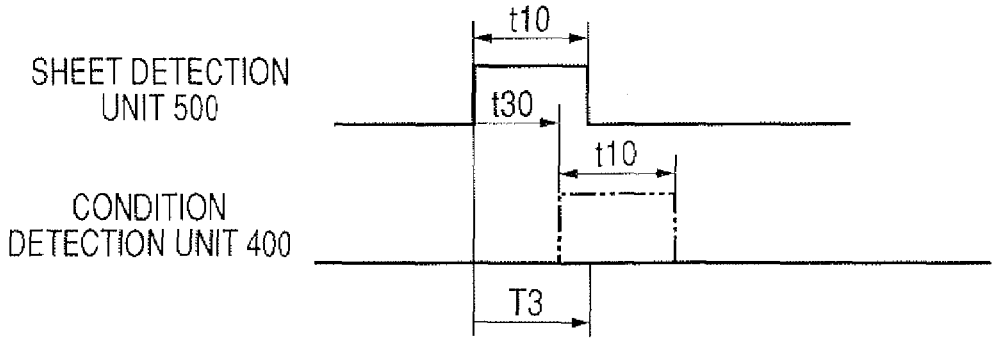

FIG. 5D illustrates a condition corresponding to FIG. 2B, where the sheet P is not discharged completely from the paired discharge rollers, but the trailing end of the sheet P remains in the discharge portion. The sheet P (sheet P1 in FIG. 2B) remains, at the trailing end thereof, in the discharge portion. Therefore the lever 401 rotates larger (third detection position) than the position in the fully stacked condition of the sheets P, whereby the optical path of the photo-interruptor 402 remains not interrupted. Therefore, the CPU 800 is incapable, even after the lapse of the prescribed time t30 from the arrival of a sheet P (sheet P2 in FIG. 2B), conveyed next to the remaining sheet P, at the sheet detection portion 500, of detecting such arrival by the condition detection portion 400. The CPU 800 recognizes a second abnormal condition when the arrival of the sheet P at the detection portion 400 of the discharge portion cannot be detected even after a specified time T3, as a third specified time, longer than the prescribed time t30 from arriving at the sheet detection potion 500.

The prescribed time t10 is a value preset according to a length of a sheet of fixed size (such as A4 size, A3 size, letter size or legal size) in the sheet conveying direction. Also t30 is a time preset based on the distance on the conveying path between the sheet detection portion 500 and the condition detection portion 400, and on the conveying speed of the sheet.

Also the specified time T3 is a sum of t30 and a predetermined time, and the predetermine time is selected in consideration of a fluctuation in the sheet conveying condition. Also the specified time T4 is preset in consideration of stiffness and curling state of the sheet, and is defined as T4=t10−α. α is a correction value determined in consideration of the stiffness and the curling state of the sheet, and is obtained by experimentally measuring the stiffness and the curling state of the sheets of plural types. Also the specified time T5 is a time preset for detecting the fully stacked condition.

Figure 6:
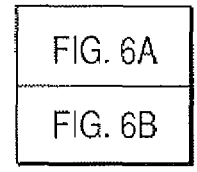
FIG. 6 is comprised of FIGS. 6A and 6B showing flow charts illustrating a sheet conveying control.
Figure 6A:
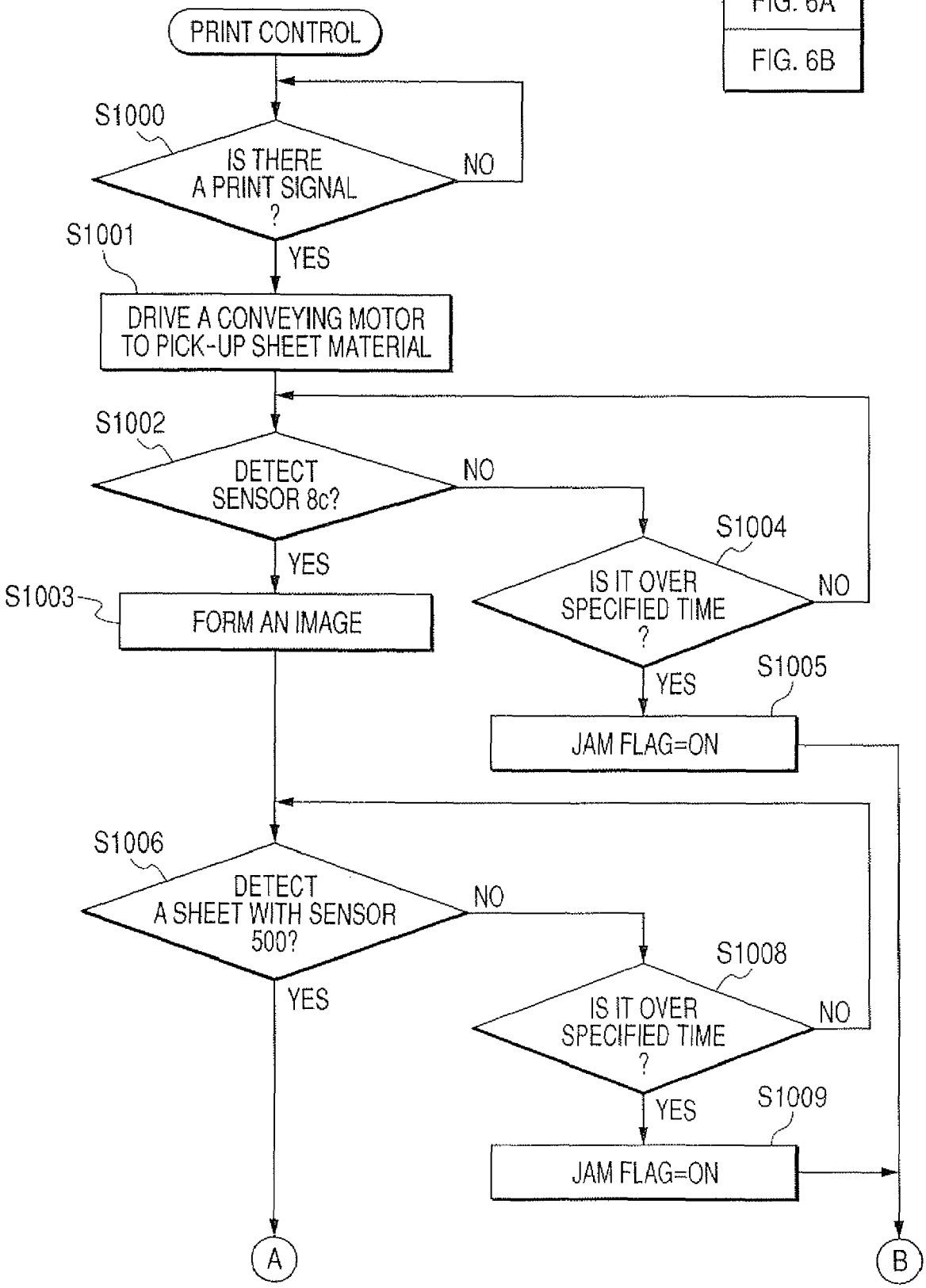
Figure 6B:
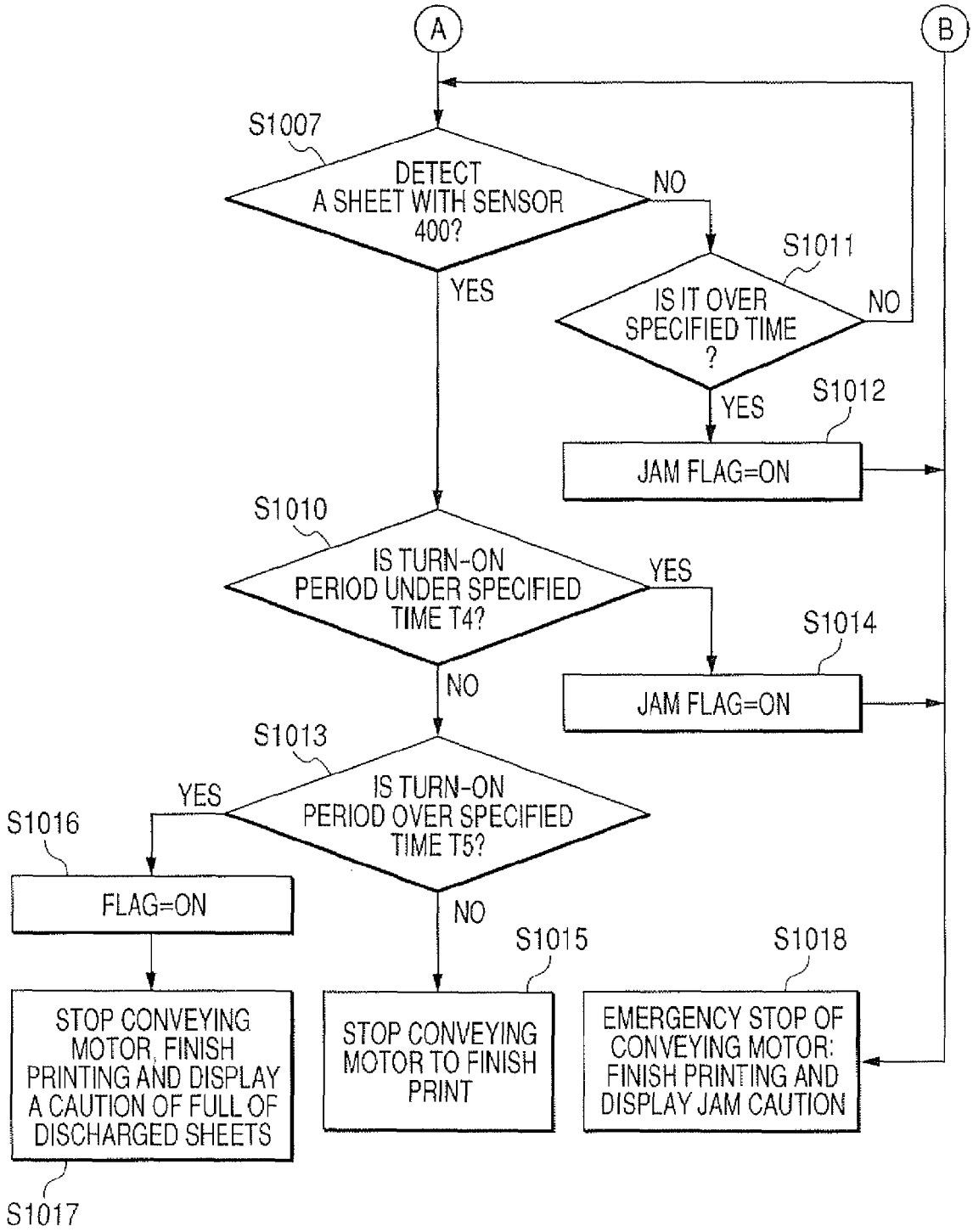

FIGS. 6A and 6B are a flow chart of sheet conveying control.

At first, presence/absence of a print signal is discriminated (step S1000). When the step S1000 detects a print signal, the conveying motor is activated to pickup a sheet P (step S1001). When the sheet P passes through the paired rollers 8*b*, the sheet P passing is detected by the detection portion 8*c* (step S1002). In the case that the step S1002 is incapable of detecting the arrival of the sheet P even after the lapse of the specified time T1 from the start of pickup operation of the sheet P in the step S1001 (step S1004), a sheet jamming at the feeding operation is recognized. Thus a status signal (jam flag status), indicating occurrence of a sheet feeding jam is turned on (step S1005). Then the conveying motor is urgently stopped and an alarm indicating a jam occurrence is displayed (step S1018). In the case that the step S1002 can detect the arrival of the sheet P within the specified time T1, the sheet P is conveyed to the image forming portion 101 and the image formation is executed (step S1003).

The sheet P, having completed the image formation, is subjected to the toner image fixation in the fixing unit 40, and the sheet detection portion 500 detects the passing of the sheet (step S1006). In the case that the step S1006 is incapable of detecting the arrival of the sheet P even after the lapse of the specified time T2 from the detection of the sheet P in the step S1002 (step S1008), a jamming at the fixation is recognized. Thus a status signal (jam flag status), indicating occurrence of a jam is turned on (step S1009). Then the conveying motor is urgently stopped and an alarm indicating a jam occurrence is displayed (step S1018). In the case that the step S1006 can detect the arrival of the sheet P within the specified time T2, the sheet P is conveyed to the discharge portion. The specified times T1 and T2 are determined in advance, based on various conditions such as the length of the sheet P in the conveying direction and the conveying speed thereof.

The sheet P conveyed to the discharge portion is conveyed by the paired discharge rollers to the exterior of the apparatus, and the passing thereof is detected by the condition detection portion 400 (step S1007). In the case that the step S1007 is incapable of detecting the arrival of the sheet P even after the lapse of the specified time T3 from the detection of the sheet P in the step S1006 (step S1011), a second abnormal condition is recognized. Thus a status signal (jam flag status), indicating occurrence of a jam is turned on (step S1012). Then the conveying motor is urgently stopped and an alarm indicating a jam occurrence is displayed (step S1018).

In the case that the step S1007 can detect the arrival of the sheet P within the specified time T3, there is discriminated whether the detection time when the sheet P passes through the detection portion 400 of the discharge portion is equal to or less than the specified time T4 (step S1010). When the detection time in the step S1010 is equal to or less than the specified time T4, a first abnormal condition is recognized and a status signal (jam flag status), indicating occurrence of a jam as the first abnormal condition is turned on (step S1014). Then the conveying motor is urgently stopped and an alarm indicating a jam occurrence is displayed (step S1018).

In the case that the detection time in the step S1010 is not equal to nor less than the specified time T4, the sheet P is discharged by the paired discharge rollers to the exterior of the apparatus and is stacked on the stacking tray 301. With the discharge of the sheet P, there is discriminated whether the detection time for the sheet P at the condition detection portion 400 is equal to or larger than the specified time T5 (step S1013). In the case that the detection time in the step S1013 is equal to or larger than the specified time T5, the stacking tray 301 is recognized as in a fully stacked condition, and a status signal (fully stacked condition flag status), indicating that the stacking trays in a fully stacked condition, is turned on (step S1016). Then the conveying motor is stopped and an alarm indicating a fully stacked condition is displayed (step S1017). In the case that the detection time in the step S1013 is not equal to nor larger than the specified time T5, the conveying motor is stopped and the image forming operation is terminated (step S1015).

As described in the foregoing, in the image forming apparatus of the present exemplary embodiment, it is determined, when the lever of the discharge portion is in the first detection position, that the amount of sheets on the stacking tray is a small amount. Also when the lever of the discharge portion is in the second detection position, it is determined that the sheets on the stacking tray is in a fully stacked condition. Also when it is in the third detection position, it is determined that the sheet on the stacking tray is in an abnormal condition. In this manner, the abnormal condition is judged according to the result of detection in the condition detection portion 400, after the sheet passes the sheet detection portion 500. Therefore, the image forming apparatus of the present exemplary embodiment provides an effect, when the sheet on the stacking tray falls into an abnormal condition, to urgently stop the image forming apparatus and to display an alarm indicating a jam occurrence, thereby facilitating jam recovery. Also as the abnormal condition can be detected utilizing the already existent sensors for detecting the sheet passage, it is not required to provide particular sensors thereby suppressing the cost increase.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-283474, filed Oct. 18, 2007, which is hereby incorporated by reference herein in its entirety.

What is claimed is:

1. An image forming apparatus comprising:

an image forming portion for forming an image on a sheet;

a sheet stack portion for stacking a sheet;

a discharge portion for discharging the sheet on which an image is formed by said image forming portion, to said sheet stack portion;

a sheet detection portion for detecting the sheet on which an image is formed before the sheet on which the image is formed by said image forming portion is discharged to said sheet stack portion;

a fully stacked condition detection portion for detecting whether sheets stacked in the sheet stack portion are in a fully stacked condition; and a determining portion that, at a time when a predetermined time period (t30) elapses after the sheet detection portion detects a leading edge of a sheet, in a case where the fully stacked condition detection portion detects the leading edge of the sheet detected by the sheet detection portion and still continues to detect the sheet for a period longer than a predetermined conveying time period corresponding to a size of the sheet, determines a condition as the fully stacked condition, wherein the determination portion, at the time when the predetermined time period elapses after the sheet detection portion detects the leading edge of the sheet, in a case where the fully stacked condition detection portion detects the leading edge of the sheet detected by the sheet detection portion and finishes detecting the sheet for a period shorter than the predetermined conveying time period, determines a condition as a first abnormal condition, and wherein the determination portion, after a period longer than the predetermined time period elapses after the sheet detection portion detects the leading edge of the sheet, in a case where the fully stacked condition detection portion does not detect the sheet detected by the sheet detection portion yet, determines a condition as a second abnormal condition.

2. An image forming apparatus according to claim 1, wherein the first abnormal condition is a condition that the sheet is in a curled condition on the stack portion.

3. An image forming apparatus according to claim 1, wherein the second abnormal condition is a condition that the sheet is in a condition where a trailing edge of the sheet remains in the stack portion.

4. An image forming apparatus according to claim 1, wherein the determining portion, in case of determining the abnormal condition, outputs a signal indicating an occurrence of the abnormal condition.

5. An image forming apparatus according to claim 1, wherein the determining portion, in case of determining the abnormal condition, terminates the sheet conveying by the image forming apparatus.

6. An image forming apparatus according to claim 1, further comprising a fixing portion for fixing the image formed by the image forming portion on the sheet, wherein the sheet detection portion is disposed at a downstream side of the fixing portion in the sheet conveying direction, and the fully stacked condition detection portion is disposed at the downstream side of the sheet detection portion in the sheet conveying direction.

7. An image forming apparatus according to claim 1, wherein the predetermined conveying time corresponds to a size of a conveyance direction of the sheet.

* * * * *